US010562167B2

(12) United States Patent
Takeuchi et al.

(10) Patent No.: US 10,562,167 B2
(45) Date of Patent: Feb. 18, 2020

(54) STRIKING TOOL

(71) Applicant: MAKITA CORPORATION, Anjo-shi, Aichi (JP)

(72) Inventors: Hajime Takeuchi, Anjo (JP); Masanori Furusawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 431 days.

(21) Appl. No.: 15/127,999

(22) PCT Filed: Mar. 25, 2014

(86) PCT No.: PCT/JP2014/058377
§ 371 (c)(1),
(2) Date: Sep. 21, 2016

(87) PCT Pub. No.: WO2015/145583
PCT Pub. Date: Oct. 1, 2015

(65) Prior Publication Data
US 2017/0106518 A1 Apr. 20, 2017

(51) Int. Cl.
*B25D 11/00* (2006.01)
*B25D 17/04* (2006.01)
(Continued)

(52) U.S. Cl.
CPC ..... *B25D 17/043* (2013.01); *B25D 11/00* (2013.01); *B25D 17/24* (2013.01); *B25F 5/006* (2013.01);
(Continued)

(58) Field of Classification Search
CPC ..... B25F 5/006; B25F 5/02; B25D 17/239; B25D 17/24; B25D 2217/0092; B25D 2250/371
(Continued)

(56) References Cited

U.S. PATENT DOCUMENTS 5,881,823 A * 3/1999 Kabatnik ..... B25D 17/00 173/217
7,186,117 B2 * 3/2007 Chen ..... B25F 5/02 173/217
(Continued)

FOREIGN PATENT DOCUMENTS

JP 2001-353668 A 12/2001
JP 2006-175586 A 7/2006
(Continued)

OTHER PUBLICATIONS

Aug. 4, 2017 Office Action issued in Japanese Patent Application No. 2016-509678.
(Continued)

*Primary Examiner* — Chelsea E Stinson
(74) *Attorney, Agent, or Firm* — Oliff PLC

(57) ABSTRACT

An improved technique relating to mounting of a battery in an impact tool which has a handle configured to move with respect to a tool body. A hammer drill has a body, a handle part and a battery mounting part. The handle part is configured to slide with respect to the body under a biasing force of a coil spring. The battery mounting part has a plurality of mounting parts. At least one of the mounting parts of the battery mounting part is connected to the handle part and slides together with the handle part with respect to the body during operation.

10 Claims, 11 Drawing Sheets

(51) Int. Cl.
*B25D 17/24* (2006.01)
*B25F 5/02* (2006.01)
*B25F 5/00* (2006.01)

(52) U.S. Cl.
CPC ..... *B25F 5/02* (2013.01); *B25D 2211/003* (2013.01); *B25D 2211/061* (2013.01); *B25D 2217/0073* (2013.01)

(58) Field of Classification Search
USPC ..... 173/162.1, 162.2
See application file for complete search history.

(56) References Cited

U.S. PATENT DOCUMENTS

| | | | | |
|---|---|---|---|---|
| 7,331,408 | B2 * | 2/2008 | Arich | B25D 16/00 173/201 |
| 8,123,098 | B2 * | 2/2012 | Miyata | B25C 1/08 227/130 |
| 9,630,310 | B2 * | 4/2017 | Ito | H02J 7/00 |
| 9,660,229 | B2 * | 5/2017 | Chellew | B25F 5/00 |
| 2001/0037889 | A1 | 11/2001 | Kristen et al. | |
| 2006/0113100 | A1 * | 6/2006 | Hsu | B25F 5/02 173/217 |
| 2006/0159577 | A1 | 7/2006 | Soika et al. | |
| 2007/0044984 | A1 * | 3/2007 | Fischer | B25D 17/043 173/217 |
| 2009/0049651 | A1 | 2/2009 | Roberts et al. | |
| 2009/0321101 | A1 * | 12/2009 | Furusawa | B25D 17/043 173/162.2 |
| 2011/0088922 | A1 * | 4/2011 | Hirayama | B25F 5/02 173/90 |
| 2011/0114347 | A1 | 5/2011 | Kasuya et al. | |
| 2011/0147031 | A1 * | 6/2011 | Matthias | B25F 5/02 173/217 |
| 2011/0198103 | A1 * | 8/2011 | Suzuki | B25F 5/00 173/46 |
| 2012/0139456 | A1 * | 6/2012 | Takano | G05B 19/048 318/139 |
| 2012/0165152 | A1 * | 6/2012 | Tokunaga | B23D 47/12 475/159 |
| 2013/0099722 | A1 | 4/2013 | Umemura et al. | |
| 2013/0199810 | A1 * | 8/2013 | Wyler | B25D 17/24 173/162.2 |
| 2014/0047722 | A1 * | 2/2014 | Onose | B27B 17/00 30/383 |

FOREIGN PATENT DOCUMENTS

| | | | |
|---|---|---|---|
| JP | 2011-088233 | A | 5/2011 |
| JP | 2011-104736 | A | 6/2011 |
| JP | 2011-161603 | A | 8/2011 |
| JP | 2011-526217 | A | 10/2011 |
| WO | 2011/162357 | A1 | 12/2011 |

OTHER PUBLICATIONS

Sep. 27, 2016 International Preliminary Report on Patentability issued in International Patent Application No. PCT/JP2014/058377.
May 20, 2014 International Search Report issued in International Patent Application No. PCT/JP2014/058377.
Dec. 7, 2017 Office Action issued in Japanese Patent Application No. 2016-509678.
Dec. 11, 2018 Office Action issued in Japanese Patent Application No. 2016-509678.

* cited by examiner

STRIKING TOOL

TECHNICAL FIELD

The present invention relates to an impact tool which performs a prescribed operation on a workpiece.

BACKGROUND ART

Japanese Unexamined Patent Application Publication (JP-A) No. 2011-104736 discloses a hammer drill which has a handle designed to be held by a user and configured to move with respect to a tool body. With this structure, transmission of vibration from the tool body to the handle is effectively suppressed during operation on a workpiece.

SUMMARY OF THE INVENTION

Problem to be Solved by the Invention

The above-described hammer drill is driven by electric current which is supplied from an external power source via a power cord. Therefore, this hammer drill is not designed to mount a detachable battery. In this point, further improvement is required.

Accordingly, it is an object of the present invention to provide an improved technique relating to mounting of a battery in an impact tool which has a handle configured to move with respect to a tool body.

Invention for Solving the Problem

The above-described problem is solved by the present invention. According to a preferred aspect of an impact tool of the present invention, the impact tool is provided which is capable of driving a detachably mounted tool accessory in a prescribed longitudinal direction. The tool accessory may not only be driven linearly in the longitudinal direction, but also be rotated around its axis. The impact tool has an electric motor for driving the tool accessory, a tool body that houses the electric motor, a handle forming member having a handle to be held by a user, an elastic member that is disposed between the tool body and the handle forming member, and at least one battery mounting part to which a battery is detachably mounted. The manner of relative arrangement of the tool body and the handle forming member suitably includes a manner in which the tool body and the handle forming member are arranged side by side in the prescribed direction apart from each other, a manner in which the tool body covers part of the handle forming member, and a manner in which the handle forming member covers part of the tool body.

Further, the at least one battery mounting part comprises a plurality of battery mounting parts to each of which the battery can be mounted. The electric motor is driven by current that is supplied from the battery mounted to the battery mounting part. The handle forming member is configured to move with respect to the tool body under an elastic force of the elastic member. At least one of the battery mounting parts is connected to the handle forming member and configured to move together with the handle forming member with respect to the tool body. Specifically, the battery mounting part is formed on the handle forming member. The elastic member suitably includes a coil spring, a leaf spring and a rubber. Typically, the handle forming member moves with respect to the tool body in the longitudinal direction in which the tool accessory is driven. The movement of the handle forming member may have a movement component in the longitudinal direction, and it is not limited to movement parallel to the longitudinal direction. Further, at least one of the two or more battery mounting parts may be connected to the handle forming member. Preferably, a plurality of the battery mounting parts may be connected to the handle forming member.

According to the present invention, the handle forming member having a handle to be held by a user moves with respect to the tool body. By this relative movement, the elastic member disposed between the handle forming member and the tool body elastically deforms and thereby suppresses transmission of vibration caused during operation to the handle forming member. Specifically, transmission of vibration to the handle held by the user is suppressed. Further, a larger kinetic energy is required to vibrate the handle forming member having a larger mass. In this invention, the battery mounting part is connected to the handle forming member, and the battery mounted to the battery mounting part and the battery mounting part move together with the handle forming member with respect to the tool body. Thus, the mass of the handle forming member side which moves with respect to the tool body is increased. Therefore, vibration of the handle forming member is effectively suppressed.

Further, a plurality of the batteries can be mounted to the impact tool. Therefore, compared with a structure in which one battery having a large capacity is mounted, the batteries each having a smaller size can be mounted, so that ease of operation of attaching and detaching the battery for replacement is improved. Further, by providing a plurality of electric connection modes (series connection and parallel connection), the impact tool can be rationally driven according to the operation.

According to a further aspect of the impact tool of the present invention, the handle is provided to extend in a handle extending direction crossing the longitudinal direction. Further, the battery is mounted to the battery mounting part by sliding with respect to the battery mounting part in a crossing direction crossing the longitudinal direction and the handle extending direction.

According to this aspect, in the structure in which the tool accessory is caused to generate an impact force in the longitudinal direction, vibration is caused mainly in the longitudinal direction. On the other hand, the battery is mounted to the battery mounting part by sliding in a direction crossing the longitudinal direction. In other words, when the battery is attached to and detached from the battery mounting part, the battery is moved in a direction crossing the longitudinal direction. Thus, the moving direction of the battery for attachment and detachment crosses a main direction component of vibration caused during operation, so that the battery is prevented from coming off the battery mounting part during operation.

According to a further aspect of the impact tool of the present invention, the handle is provided to extend in a handle extending direction crossing the longitudinal direction. Further, at least part of the handle is arranged on an axis of the tool accessory. In other words, part of a region to be held by a user is arranged on the axis of the tool accessory.

According to this aspect, during operation on a workpiece, the user can apply a force to the handle provided on the axis (hammering axis) of the tool accessory. As a result, the user's force applied to the handle is rationally transmitted to the workpiece during operation.

According to a further aspect of the impact tool of the present invention, the electric motor is arranged such that a rotation axis of the electric motor extends in a direction crossing the longitudinal direction. Particularly, it is preferable that the rotation axis of the electric motor extends in a direction perpendicular to the longitudinal direction.

According to a further aspect of the impact tool of the present invention, the electric motor is arranged such that a rotation axis of the electric motor extends in parallel to the longitudinal direction.

According to a further aspect of the impact tool of the present invention, the handle forming member has a connection part which connects a region of the handle forming member located toward the tool accessory from the handle in the longitudinal direction and one end region of the handle. Thus, the handle forming member is formed in a loop shape by the handle and the connection part.

According to this aspect, the handle to be held by a user is reinforced by the connection part. Therefore, the user's force applied to the handle is rationally transmitted to the workpiece during operation. Further, by forming the handle forming member in a loop shape, the strength of the handle forming member is increased According to a further aspect of the impact tool of the present invention, the battery mounting part is connected to one end region of the handle in the handle extending direction. The other end region of the handle is connected to the tool body.

According to this aspect, the battery mounting part is connected to one end region of the handle. Generally, a battery having a relatively large mass is mounted to the battery mounting part. Therefore, the impact tool is balanced in the handle extending direction by the battery and the tool body having the electric motor housed therein. As a result, the operability of the impact tool is enhanced, and a load on the user holding the handle is reduced.

According to a further aspect of the impact tool of the present invention, the battery mounting part is connected to the connection part. Specifically, the battery mounting part is provided on the connection part.

According to this aspect, by providing the battery mounting part on the connection part, a space on the connection part is effectively utilized. Further, the connection part has two functions of reinforcing the handle and holding the battery mounting part.

According to a further aspect of the impact tool of the present invention, the elastic member comprises a plurality of elastic elements provided at plural places, and the handle forming member is configured to move with respect to the tool body under elastic forces of the elastic elements. Two or more elastic elements may be provided, and the number of the elastic elements is not limited. Preferably, two elastic elements of the elastic member may be arranged on opposite sides of an axis of the tool accessory in the handle extending direction. More preferably, the two elastic elements may be arranged substantially at the same position in the longitudinal direction.

According to this aspect, with the structure in which the handle forming member is biased by a plurality of the elastic elements, the elastic forces of the elastic elements act upon the handle forming member in a balanced manner. Therefore, the handle forming member stably moves with respect to the tool body.

Effect of the Invention

According to the present invention, an improved technique relating to mounting of a battery is provided in an impact tool which has a handle configured to move with respect to a tool body.

Other objects, features and advantages of the present invention will be readily understood after reading the following detailed description together with the accompanying drawings and the claims.

REPRESENTATIVE EMBODIMENT FOR CARRYING OUT THE INVENTION

Each of the additional features and method steps disclosed above and below may be utilized separately or in conjunction with other features and method steps to provide improved impact tools and devices utilized therein. Representative examples of this invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

Figure 1:
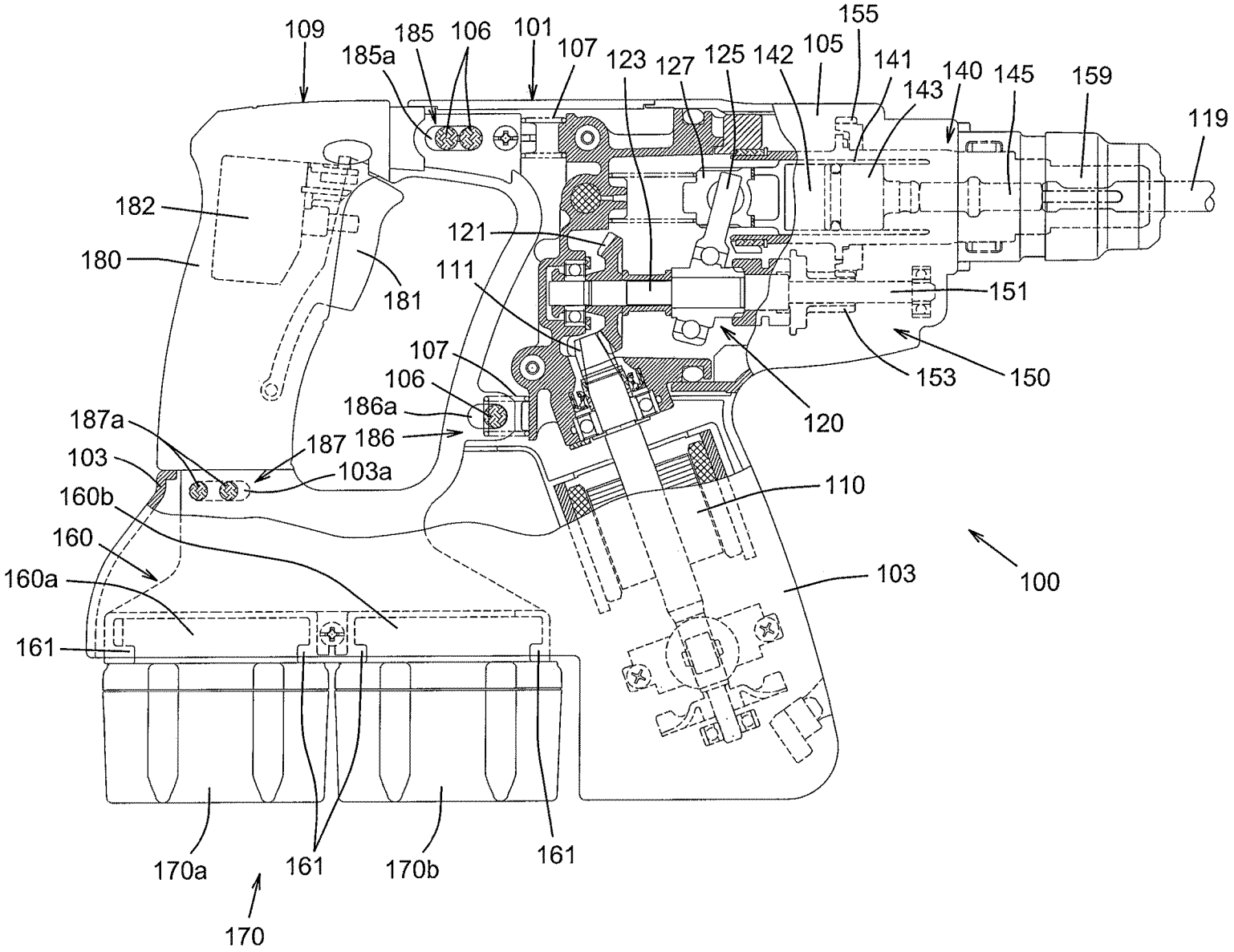
FIG. 1 is a sectional view showing an overall structure of a hammer drill according to a first embodiment of the present invention.

A battery-powered hammer drill is described as a representative example of an impact tool according to an embodiment of the present invention. A first embodiment of the present invention is now described with reference to FIGS. 1 to 7. As shown in FIG. 1, a hammer drill 100 is an impact tool for performing a drilling operation and a chipping operation on a workpiece by causing a hammer bit 119 to move linearly in its axial direction and rotate around its axis.

The hammer bit 119 is an example embodiment that corresponds to the "tool accessory" according to the present invention.

The hammer drill 100 mainly includes a body 101 that forms an outer shell of the hammer drill 100 and a handle part 109. The hammer bit 119 is removably coupled to a front end region of the body 101 via a cylindrical tool holder 159. The hammer bit 119 is held by the tool holder 159 such that it is allowed to reciprocate with respect to the tool holder 159 in the axial direction of the hammer bit 119 and prevented from rotating in a circumferential direction with respect to the tool holder 159.

(Structure of the Body)

The body 101 mainly includes a motor housing 103 and a gear housing 105. The motor housing 103 houses an electric motor 110. The gear housing 105 houses a motion converting mechanism 120, a striking mechanism 140 and a power transmitting mechanism 150. The handle part 109 is arranged on a side of the body 101 opposite to the hammer bit 119 in the axial direction of the hammer bit 119. For the sake of explanation, the hammer bit 119 side (right side as viewed in FIG. 1) and the handle part 109 side (left side as viewed in FIG. 1) are defined as a "front side of the hammer drill" and a "rear side of the hammer drill", respectively, in the axial direction of the hammer bit 119 (a longitudinal direction of the body 101). Further, the upper side and the lower side as viewed in FIG. 1 are defined as an "upper side of the hammer drill" and a "lower side of the hammer drill", respectively.

The electric motor 110 is arranged such that its rotation axis extends in a direction crossing (oblique to) the axil direction of the hammer bit 119. The electric motor 110 is an example embodiment that corresponds to the "electric motor" according to the present invention. The body 101 having the motor housing 103 for housing the electric motor 110 is an example embodiment that corresponds to the "tool body" according to the present invention.

The rotating output of the electric motor 110 is converted into linear motion by the motion converting mechanism 120 and then transmitted to the striking mechanism 140. As a result, the hammer bit 119 is caused to generate an impact force in the axial direction of the hammer bit 119 (horizontal direction as viewed in FIG. 1) via the striking mechanism 140.

The motion converting mechanism 120 mainly includes a bevel gear 121, a first intermediate shaft 123, a swinging member 125 and a cylinder holding part 127. The bevel gear 121 is driven by engagement with a drive gear 111 provided on a rotation axis of the electric motor 110. The first intermediate shaft 123 is arranged parallel to the axial direction of the hammer bit 119 and rotates together with the bevel gear 121. The rotating output of the electric motor 110 is decelerated via the drive gear 111 and the bevel gear 121 and transmitted to the first intermediate shaft 123. A lower end part of the swinging member 125 is engaged with the first intermediate shaft 123 and caused to swing in the axial direction of the hammer bit 119 by rotation of the first intermediate shaft 123. The cylinder holding part 127 is connected to an upper end part of the swinging member 125. Therefore, the cylinder holding part 127 is caused to linearly move in the axial direction of the hammer bit 119 by swinging of the swinging member 125.

The striking mechanism 140 mainly includes a piston cylinder 141, a striker 143 and an impact bolt 145. The piston cylinder 141 is a cylindrical member having a closed rear end and an open front end. The piston cylinder 141 is connected to the cylinder holding part 127 and thus linearly moves in the axial direction of the hammer bit 119. The striker 143 is slidably disposed within the piston cylinder 141. An air chamber 142 is defined within the piston cylinder 141 by the striker 143 and the piston cylinder 141.

The impact bolt 145 is disposed in front of the striker 143 and held by the tool holder 159 so as to be movable in a front-back direction. The striker 143 is caused to slide via an action of an air spring of the air chamber 142 which is caused by movement of the piston cylinder 141 in the front-back direction, and collides with the impact bolt 145. Then, the impact bolt 145 collides with the hammer bit 119 and moves the hammer bit 119 forward, and the hammer bit 119 performs a hammering operation on a workpiece.

Further, the rotating output of the electric motor 110 is decelerated by the power transmitting mechanism 150 and then transmitted to the tool holder 159. As a result, the hammer bit 119 held by the tool holder 159 is rotated in the circumferential direction. The power transmitting mechanism 150 mainly includes a second intermediate shaft 151, a first intermediate gear 153 and a second intermediate gear 155. The second intermediate shaft 151 is arranged coaxially with the first intermediate shaft 123 and rotates together with the first intermediate shaft 123. The first intermediate gear 153 is fitted onto the second intermediate shaft 151 and rotates together with the second intermediate shaft 151. The second intermediate gear 155 is connected to the tool holder 159. Further, the second intermediate gear 155 is engaged with the first intermediate gear 153 and driven by the first intermediate gear 153. With the above-described structure, the power transmitting mechanism 150 transmits rotation of the electric motor 110 to the tool holder 159, which causes the hammer bit 119 to rotate. As a result, the hammer bit 119 performs a rotating (drilling) operation on a workpiece.

(Structure of the Handle Part)

The handle part 109 mainly includes a handgrip 180, a trigger 181, a trigger switch 182, a first slide guide 185, a second slide guide 186 and a third slide guide 187. The handgrip 180 is arranged to extend in a direction crossing the axial direction of the hammer bit 119 and extend in a vertical direction of the hammer drill 100. Part of the handgrip 180 to be held by a user is arranged on an axis (hammering axis) of the hammer bit 119, and the trigger 181 is provided in this region. With this structure, during operation on a workpiece, the user can apply a force to the handgrip 180 provided on the hammering axis. As a result, the user's force applied to the handgrip 180 is rationally transmitted to the workpiece. The handle part 109 and the handgrip 180 are example embodiments that correspond to the "handle forming member" and the "handle", respectively, according to the present invention.

The trigger 181 is connected to the trigger switch 182. The trigger switch 182 is turned on and off by user's operation of the trigger 181. When the trigger switch 182 is turned on, electric current is supplied from a battery pack 170 mounted to a battery mounting part 160 and the electric motor 110 is driven.

The first slide guide 185 and the second slide guide 186 are configured in the form of slots 185*a* and 186*a*, respectively, in a front region of the handle part 109. The slots 185*a*, 186*a* are formed to extend in the axial direction of the hammer bit 119. The first slide guide 185 is formed in an upper region of the handle part 109 and the second slide guide 186 is formed in a lower region of the handle part 109.

The slots 185*a*, 186*a* of the first and second slide guides 185, 186 are engaged with respective guide shafts 106 fixed to the gear housing 105, so that the first and second slide guides 185, 186 slide in the front-back direction with respect to the guide shafts 106 (the gear housing 105). The guide shafts 106 are arranged to extend in a transverse direction of the hammer drill 100 which crosses both the axial direction of the hammer bit 119 and the extending direction of the handgrip 180. A coil spring 107 is disposed between the handle part 109 and the gear housing 105. Two such coil springs 107 are arranged at upper and lower positions corresponding to the first and second slide guides 185, 186. The coil spring 107 is an example embodiment that corresponds to the "elastic member" according to the present invention.

The third slide guide 187 is formed in a rear region of the handle part 109 and has a guide shaft 187*a* formed below the handgrip 180. Specifically, the third slide guide 187 is disposed between the handgrip 180 of the handle part 109 and the battery mounting part 160. Further, the motor housing 103 is configured to cover a region having the third slide guide 187 in the handle part 109, and has a slot 103*a* which is engaged with the guide shaft 187*a*. Thus, the third slide guide 187 slides in the front-back direction with respect to the slot 103*a* (the motor housing 103). The guide shaft 187*a* is arranged to extend in a transverse direction of the hammer drill 100 which crosses both the axial direction of the hammer bit 119 and the extending direction of the handgrip 180. The third slide guide 187 is configured to support the sliding movement of the handle part 109 with respect to the body 101, and no coil spring 107 is provided in a region corresponding to the third slide guide 187.

Figure 2:
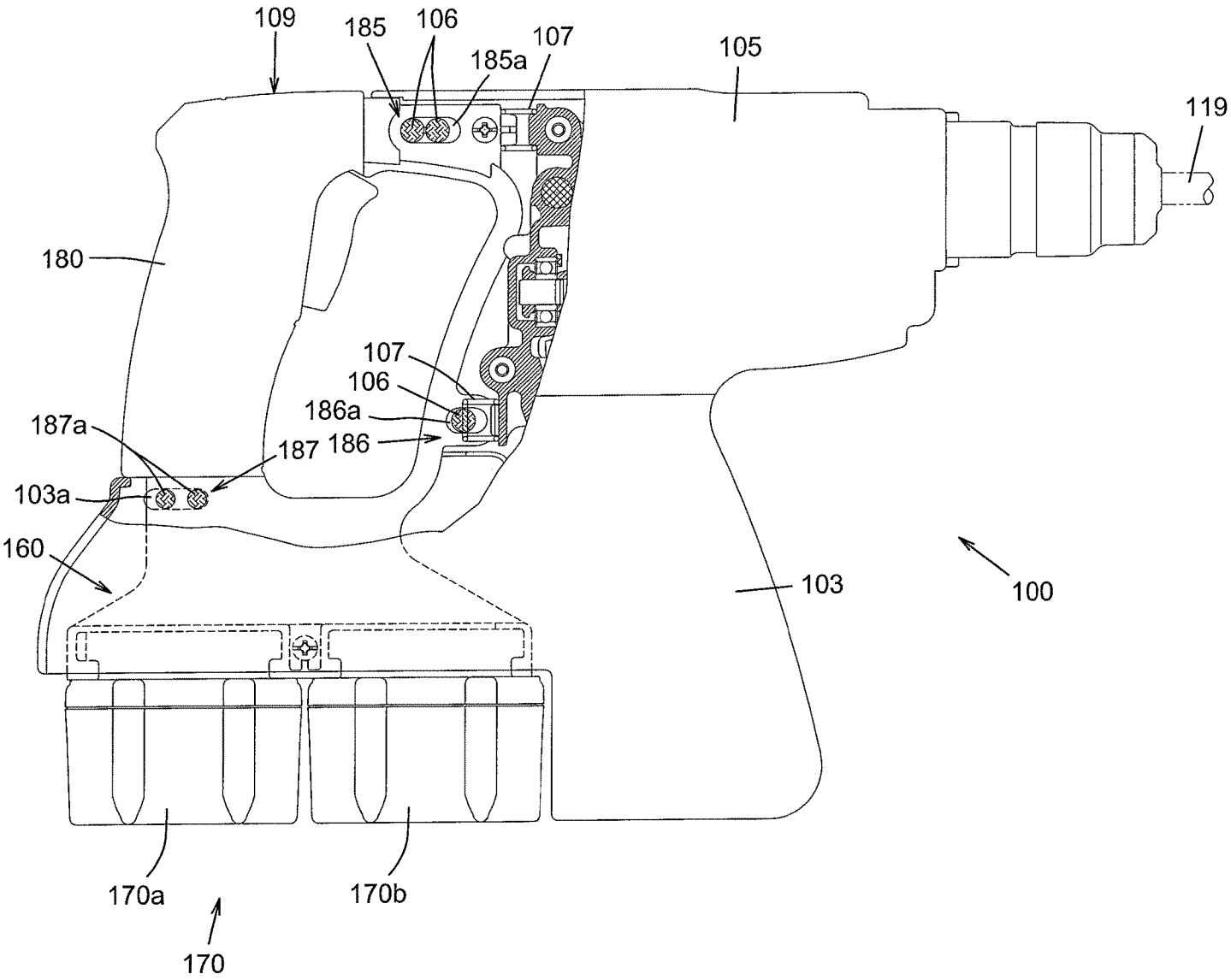
FIG. 2 is a sectional view for showing the state in which the handle is in a front position in the hammer drill of FIG. 1.

With the above-described structure, the handle part 109 slides between a position (rear position) shown in FIG. 1 and a position (front position) shown in FIG. 2 while the biasing forces of the coil springs 107 are applied to the gear housing 105 (the body 101). As a result, vibration which is caused during operation on a workpiece and transmitted to the handle part 109 is suppressed. Therefore, the handle part 109 is hereinafter also referred to as a vibration-proof handle.

(Structure of the Battery Mounting Part)

Figure 3:
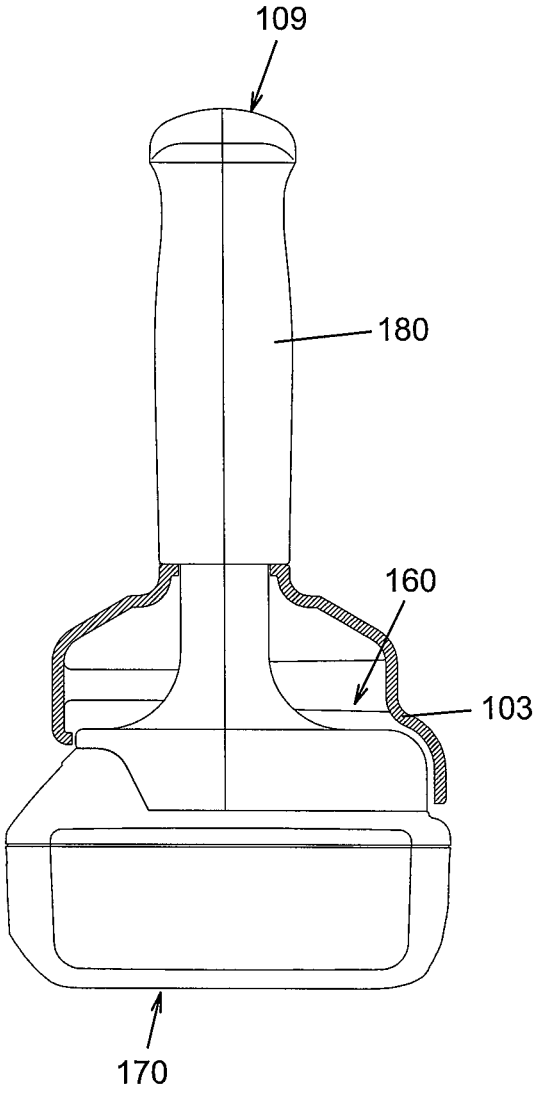
FIG. 3 is a rear view, partly in section, showing the hammer drill of FIG. 1.

As shown in FIGS. 1 and 2, the battery mounting part 160 is integrally formed with the handle part 109 on a lower end of the handle part 109. Specifically, the battery mounting part 160 is connected to the handle part 109. Therefore, when the handle part 109 slides with respect to the gear housing 105 (the body 101), the battery mounting part 160 (the battery pack 170) also moves in the front-back direction. The battery mounting part 160 has two mounting parts 160*a*, 160*b* arranged side by side in the front-back direction. The mounting parts 160*a*, 160*b* have the same structure, and the battery pack 170 is detachably mounted to each of the mounting parts 160*a*, 160*b*. Each of the mounting parts 160*a*, 160*b* has a guide rail 161 extending in the transverse direction of the hammer drill 100 (horizontal direction as viewed in FIG. 3) crossing the front-back direction of the hammer drill 100. With this structure, as shown in FIG. 3, the battery pack 170 is attached to and detached from the battery mounting part 160 by sliding in the transverse direction of the hammer drill 100. The battery mounting part 160 is an example embodiment that corresponds to the "battery mounting part" in the present invention.

As shown in FIG. 1, for the sake of explanation, the battery packs 170 (170*a*, 170*b*) mounted to the respective mounting parts 160*a*, 160*b* are shown having the same shape. Specifically, the battery packs 170*a*, 170*b* can be mounted to either of the mounting parts 160*a*, 160*b*. The battery pack 170 is an example embodiment that corresponds to the "battery" in the present invention.

(Structure of the Battery Pack)

Figure 4:
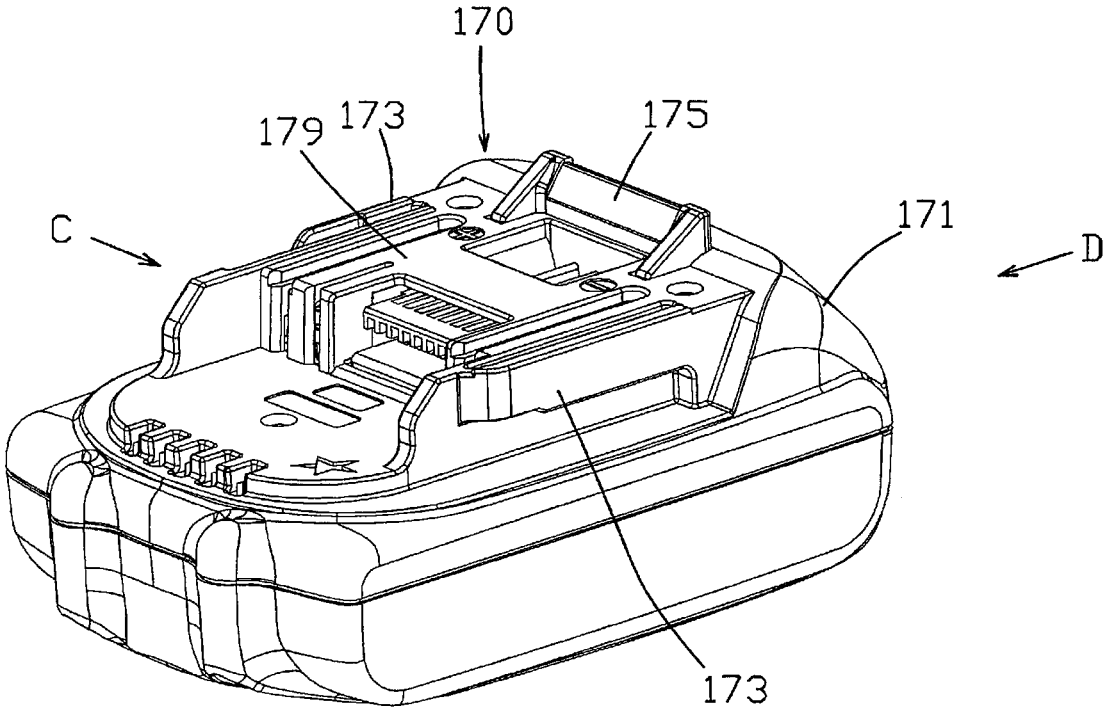
FIG. 4 is a perspective view showing a battery pack.
Figure 5:
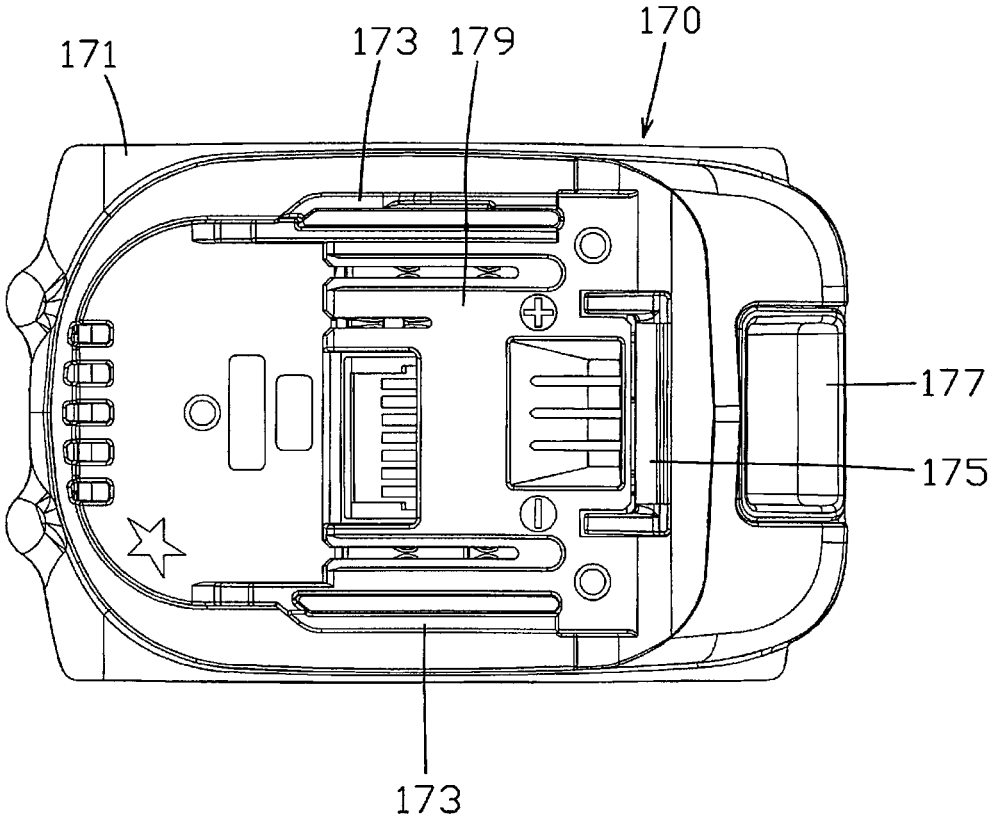
FIG. 5 is a plan view showing the battery pack.
Figure 6:
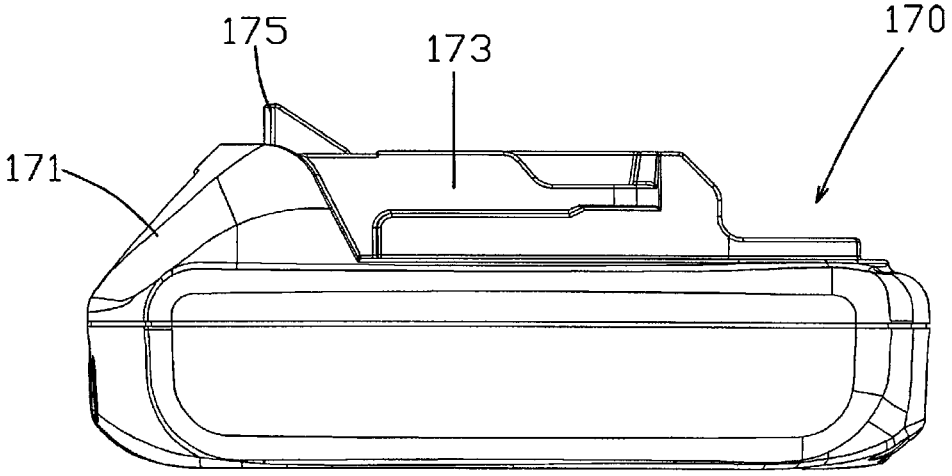
FIG. 6 is a view as viewed from a direction of arrow C in FIG. 4.
Figure 7:
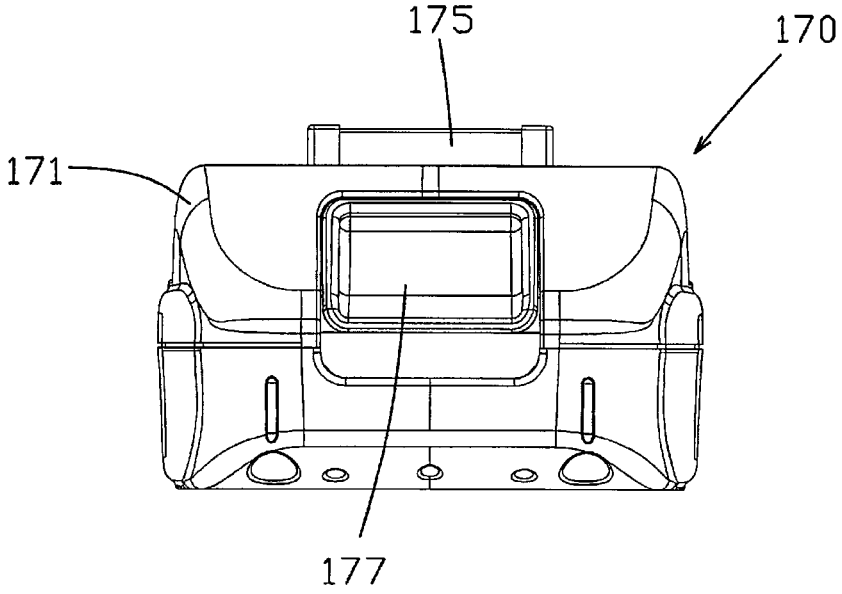
FIG. 7 is a view as viewed from a direction of arrow D in FIG. 4.

As shown in FIGS. 4 to 7, the battery pack 170 mainly includes a generally rectangular battery case 171 and a plurality of battery cells (not shown) housed in the battery case 171. As shown in FIG. 4, a pair of mounting guides 173 are provided on an upper surface of the battery case 171 and linearly extend along the longitudinal direction of the battery pack 170. The mounting guides 173 are configured to engage with the guide rails 161 of the mounting part 160*a* (160*b*).

Further, as shown in FIGS. 4 to 7, a hook 175 for locking the battery pack 170 to the battery mounting part 160 and a push button 177 for releasing the lock are provided in a central part of the upper surface of the battery case 171. The hook 175 is biased by a spring (not shown) so as to protrude from the upper surface of the battery case 171. The push button 177 is disposed in one end region of the battery case 171 in the longitudinal direction of the battery case 171 and mechanically connected to the hook 175 such that the hook 175 retracts from the upper surface of the battery case 171 when the push button 177 is pressed.

As shown in FIGS. 1 to 3, the battery pack 170*a* (170*b*) is mounted to the battery mounting part 160*a* (160*b*). At this time, the hook 175 of the battery pack 170*a* (170*b*) is engaged with an engagement part (not shown) of the mounting part 160*a* (160*b*), so that the battery pack 170*a* (170*b*) is fixed to the mounting part 160*a* (160*b*). Further, a terminal 179 of the battery pack 170*a* (170*b*) is electrically connected to a terminal (not shown) of the mounting part 160*a* (160*b*), so that current can be supplied to the hammer drill 100.

In a case of the hammer drill 100 of 36 V specification, for example, the battery packs 170*a*, 170*b* of 18 V each are mounted and electrically connected in series. A battery pack of 18 V is lighter than a battery pack of 36 V, so that the user can more easily attach and detach the battery packs 170*a*, 170*b*. In a case of the hammer drill 100 of 18 V specification, for example, the two battery packs 170*a*, 170*b* are electrically connected in parallel. In this case, only either one of the battery packs 170*a*, 170*b* may be mounted to drive the hammer drill 100. Further, in a case of the hammer drill 100 which can be driven either by 36 V or 18 V, it may be configured such that the connection mode of the two battery packs 170*a*, 170*b* can be switched between series connection and parallel connection. In this case, it is preferred to provide a changeover switch for switching the connection between the terminals of the mounting parts 160*a*, 160*b* in order to switch the connection mode of the battery packs 170*a*, 170*b* by user's operation.

According to the above-described first embodiment, the battery pack 170 moves together with the handle part 109 with respect to the gear housing 105 (the body 101). With this structure, transmission of vibration to the battery pack 170 is suppressed. Thus, the battery pack 170 is prevented from coming off the battery mounting part 160 during operation. Further, the guide rails 161 of the mounting parts 160*a*, 160*b* are arranged to extend in a direction crossing the axial direction of the hammer bit 119. Thus, the battery pack 170 is mounted to the mounting parts 160*a*, 160*b* by sliding in the direction crossing the axial direction of the hammer bit 119. Therefore, the attaching/detaching direction of the battery pack 170 crosses the front-back direction (the axial direction of the hammer bit 119) in which vibration is mainly caused during hammering operation. With this structure, the battery pack 170 is further effectively prevented from coming off the battery mounting part 160 during operation.

Further, according to the first embodiment, the battery pack 170 is mounted close to the handgrip 180 of the handle part 109 below the handgrip 180. Thus, the center of gravity of the battery pack 170 is located close to the handgrip 180 in the axial direction of the hammer bit 119. With this structure, compared with a structure in which the center of gravity of the battery pack 170 is located away from the handgrip 180, a load on the user holding the handgrip 180 during operation is reduced.

Second Embodiment

A second embodiment of the present invention is now described with reference to FIGS. 8 and 9. The hammer drill 100 of the second embodiment is different from the hammer drill 100 of the first embodiment mainly in the arrangement of the electric motor 110 and the shape of the handle part 109. Other components which are substantially identical to those of the hammer drill 100 in the first embodiment are given like numerals and are not described.

The handle part 109 has a support part 109*a* connected to the handgrip 180. The handgrip 180 is configured to extend in a direction (vertical direction as viewed in FIG. 8) crossing the axial direction of the hammer bit 119. A base end (upper end as viewed in FIG. 8) of the handgrip 180 is arranged close to the axis of the hammer bit 119, and a distal end (lower end as viewed in FIG. 8) of the handgrip 180 is connected to the support part 109*a*. Therefore, the user can hold the hammer drill 100 in plural holding manners. Specifically, as a first holding manner, the user may hold a region of the handgrip 180 below the electric motor 110 in a direction (vertical direction in FIG. 8) crossing the axial direction of the hammer bit 119. As a second holding manner, the user may hold a region of the handgrip 180 located on the axis (hammering axis) of the hammer bit 119 behind the electric motor 110 in the axial direction of the hammer bit 119. In the second holding manner, during operation on a workpiece, the user's hand is placed on the hammering axis, so that the user's force applied to the handgrip 180 is rationally transmitted to the workpiece.

The support part 109*a* is connected to a region of the handle part 109 located toward the hammer bit 119 (the front end of the hammer drill 100) from the base end of the handgrip 180 in the axial direction of the hammer bit 119. Thus, the handle part 109 is formed in a loop shape, and the support part 109*a* supports the handgrip 180. The strength of the handle part 109 is increased by forming the handle part 109 in a loop shape. The support part 109*a* is an example embodiment that corresponds to the "connection part" in the present invention.

The battery mounting part 160 for mounting a plurality of battery packs 170*a*, 170*b* is formed on the support part 109*a*. The battery packs 170*a*, 170*b* are mounted to the battery mounting part 160 by sliding in a transverse direction of the hammer drill 100 which crosses both the axial direction of the hammer bit 119 and the extending direction of the handgrip 180. Therefore, the support part 109*a* has a function of increasing the strength of the handle part 109 and a function of holding the battery mounting part 160. Further, the structure of the battery pack 170 mounted to the battery mounting part 160 and the connection mode of the battery pack 170 are the same as those in the first embodiment.

The handle part 109 is arranged to cover the motor housing 103 and has a first slide guide 185 and a second slide guide 186. The first and second slide guides 185, 186 are configured in the form of through holes formed through a rib on the inside of the handle part 109 and extending in the axial direction of the hammer bit 119.

The motor housing 103 has two guide shafts 106 extending in the axial direction of the hammer bit 119. Each of the guide shafts 106 has a cylindrical shape, and a coil spring 107 is fitted on the guide shaft 106. One end of the coil spring 107 is held in contact with the motor housing 103 and the other end is held in contact with the handle part 109. The guide shaft 106 is slidably inserted through the through hole of the associated first or second slide guide 185, 186. Further, a screw 106*a* is fitted in the guide shaft 106, so that the guide shaft 106 is prevented from slipping off the associated first or second slide guide 185, 186 by a head of the screw 106*a*.

Figure 8:
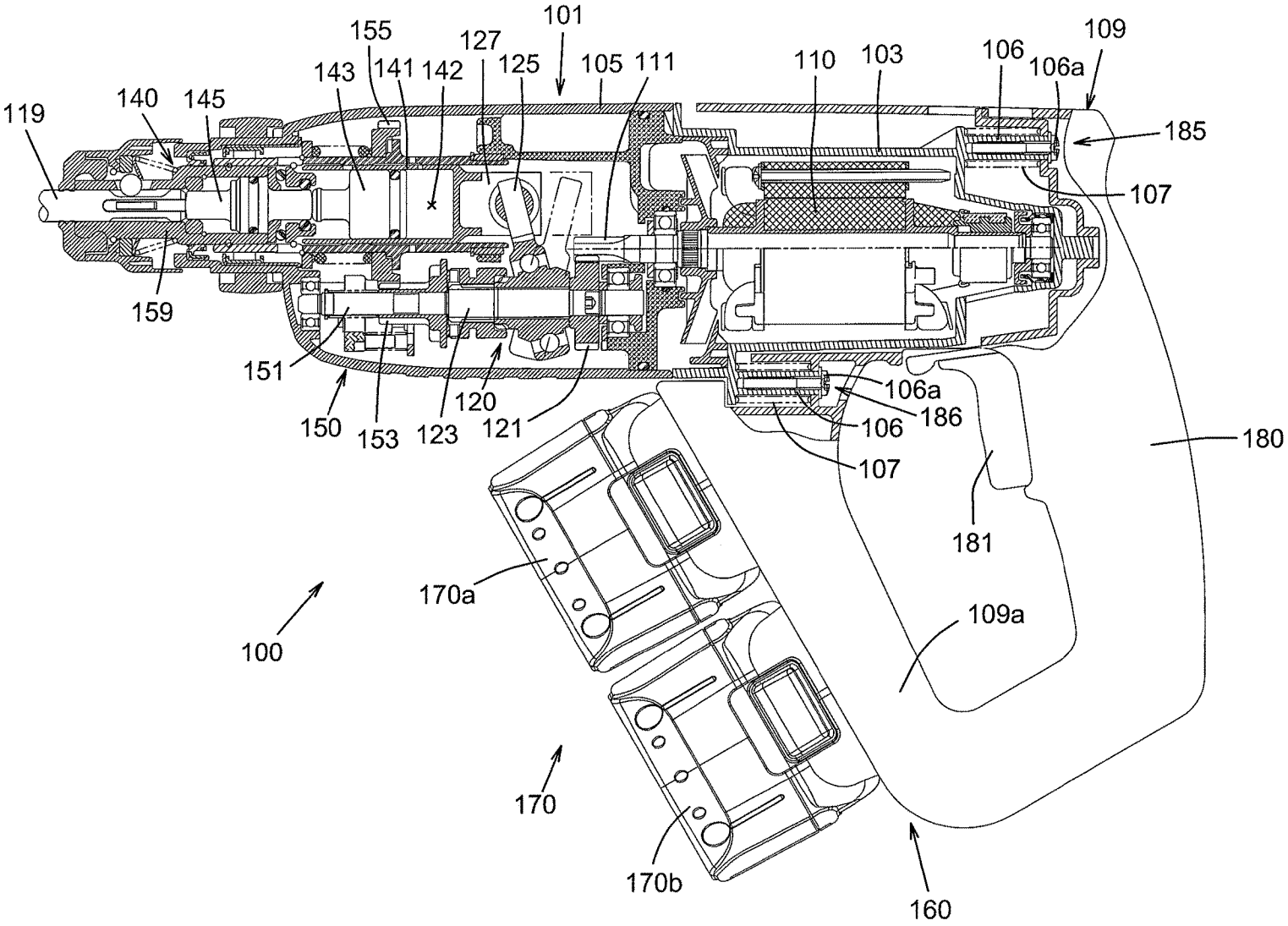
FIG. 8 is a sectional view showing an overall structure of a hammer drill according to a second embodiment of the present invention.
Figure 9:
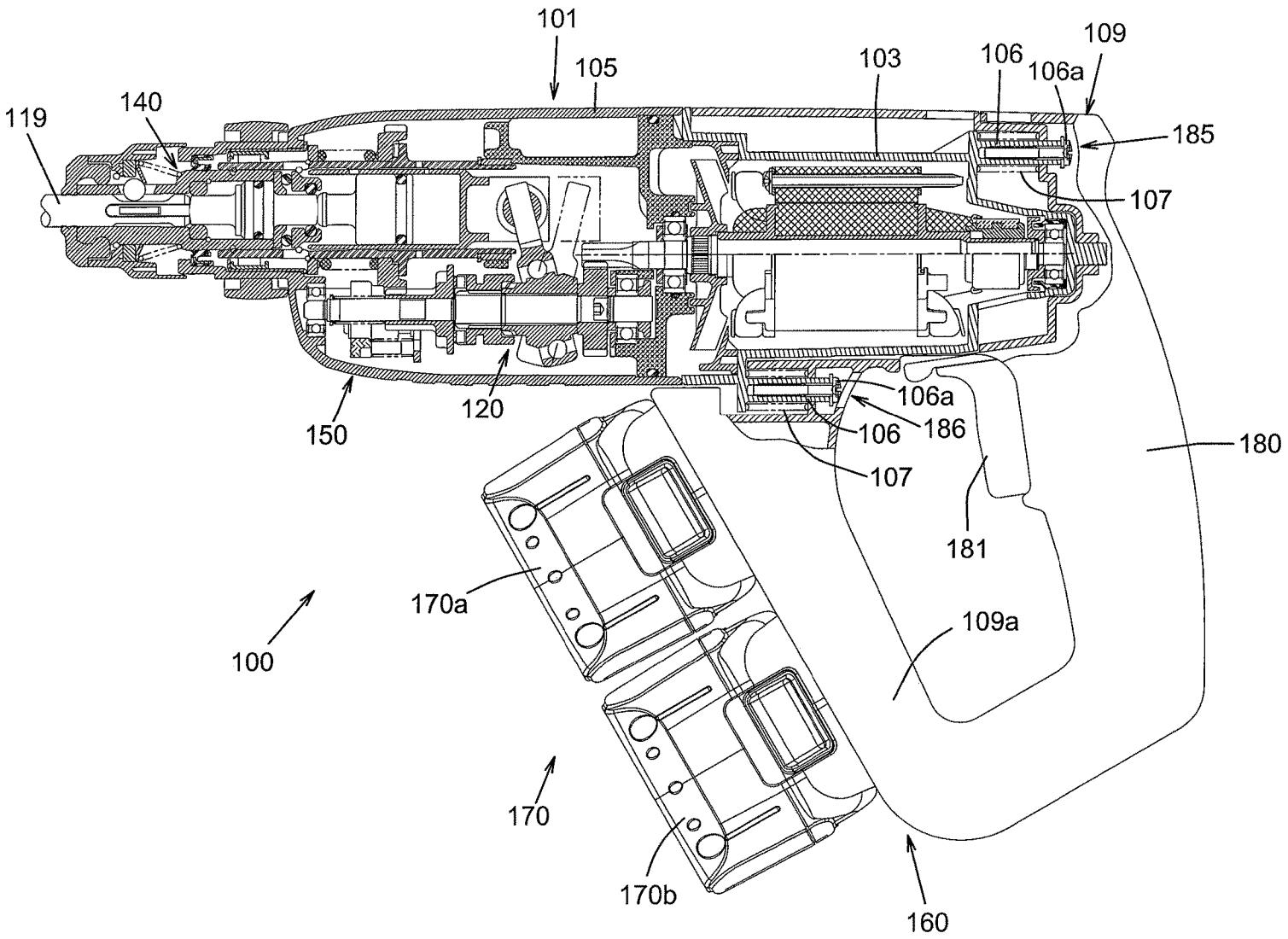
FIG. 9 is a sectional view for showing the state in which the handle is in a front position in the hammer drill of FIG. 8.

With the above-described structure, the handle part 109 slides between a position (rear position) shown in FIG. 8 and a position (front position) shown in FIG. 9 while the biasing forces of the coil springs 107 are applied to the motor housing 103 (the body 101). As a result, vibration which is caused during operation on a workpiece and transmitted to the handle part 109 is suppressed.

Third Embodiment

Figure 10:
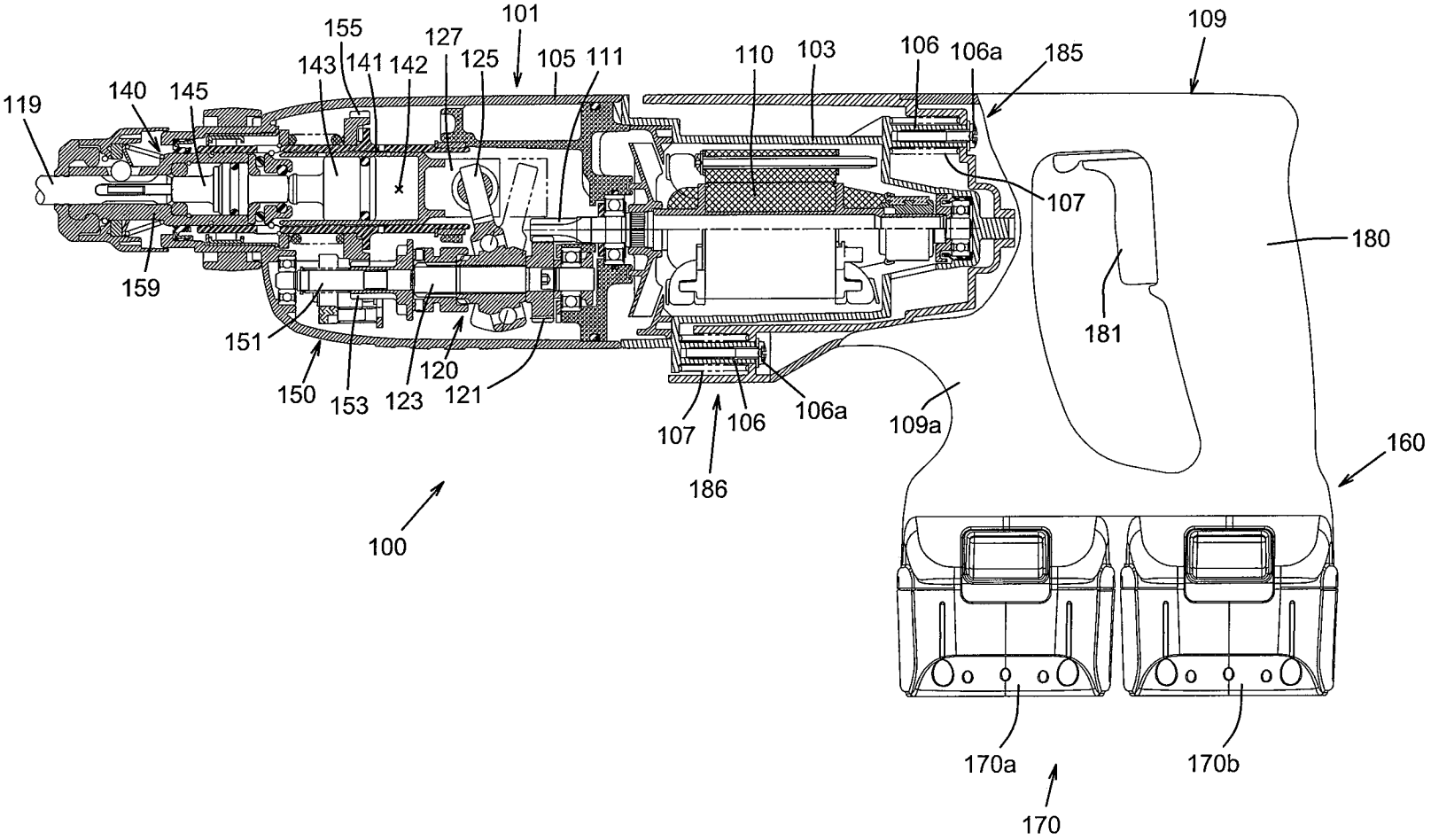
FIG. 10 is a sectional view showing an overall structure of a hammer drill according to a third embodiment of the present invention.
Figure 11:
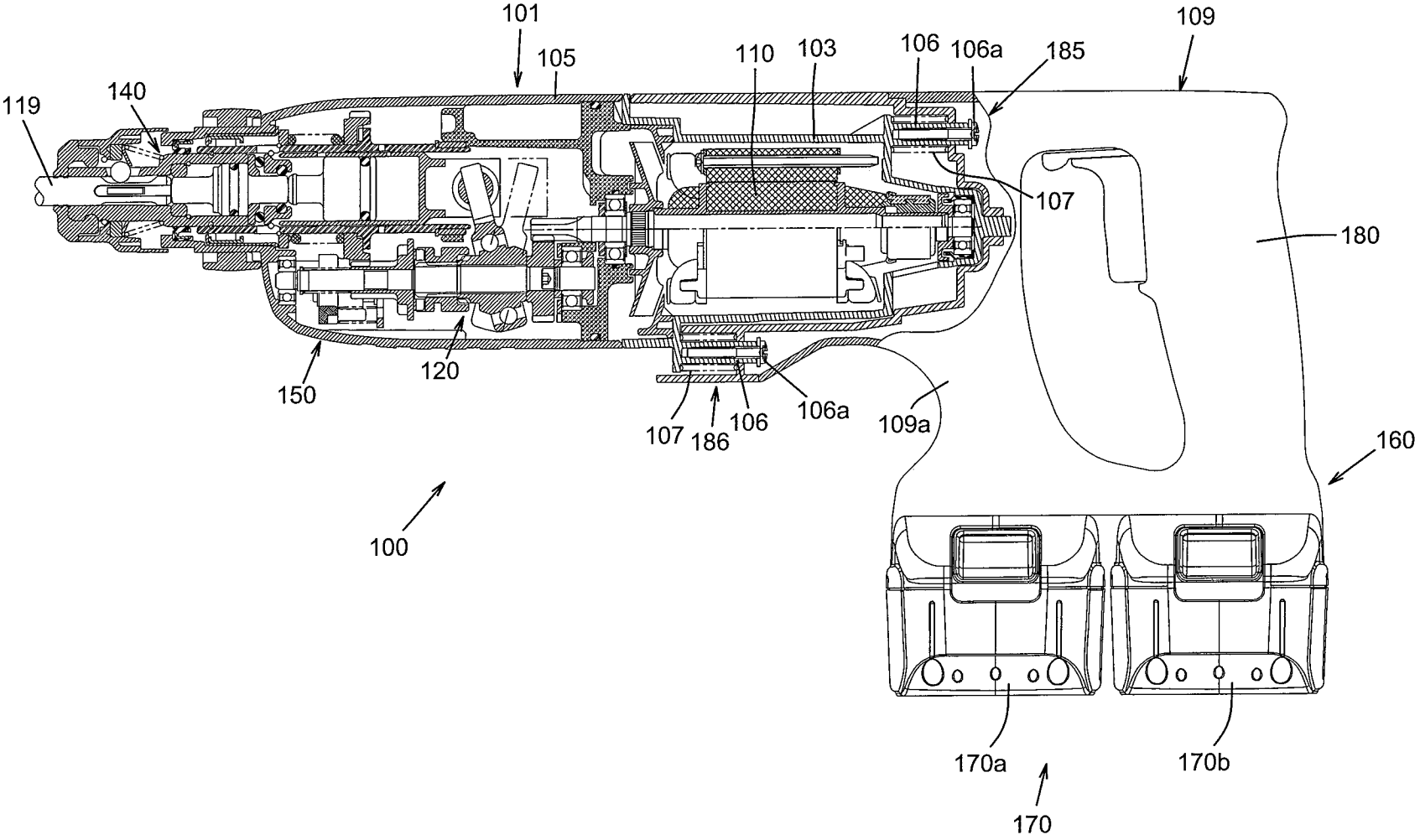
FIG. 11 is a sectional view for showing the state in which the handle is in a front position in the hammer drill of FIG. 10.

A third embodiment of the present invention is now described with reference to FIGS. 10 and 11. The hammer drill 100 of the third embodiment is different from the hammer drill 100 of the second embodiment mainly in the shape of the handle part 109. Other components which are substantially identical to those of the hammer drill 100 in the first and second embodiments are given like numerals and are not described.

In the third embodiment, the handgrip 180 and the trigger 181 of the handle part 109 are arranged on the axis (hammering axis) of the hammer bit 119 like in the first embodiment, and the handle part 109 has a support part 109*a* like in the second embodiment.

The battery mounting part 160 is provided in a connecting region between the handgrip 180 and the support part 109*a*. Specifically, the battery mounting part 160 is provided on a lower end region of the handle part 109. A plurality of battery packs 170*a*, 170*b* are mounted to the battery mounting part 160 by sliding in a transverse direction of the hammer drill 100 which crosses both the axial direction of the hammer bit 119 and the extending direction of the handgrip 180. Thus, the battery mounting part 160 is rationally arranged by utilizing the lower end region of the handle part 109. Further, the structure of the battery pack 170 mounted to the battery mounting part 160 and the connection mode of the battery pack 170 are the same as those in the first embodiment.

In the third embodiment, like in the second embodiment, the handle part 109 is arranged to cover the motor housing 103 and configured to slide with respect to the motor housing 105 via the first and second slide guides 185, 186. Therefore, the handle part 109 slides between a position (rear position) shown in FIG. 10 and a position (front position) shown in FIG. 11 while the biasing forces of the coil springs 107 are applied to the motor housing 103 (the body 101). As a result, vibration which is caused during operation on a workpiece and transmitted to the handle part 109 is suppressed.

According to the above-described first to third embodiments, the battery mounting part 160 is connected to the handle part 109. Thus, the battery mounting part 160 moves together with the handle part 109 with respect to the body 101. Therefore, the mass of the handle part 109 side which moves with respect to the body 101 is increased by the battery mounting part 160 and the battery pack 170 mounted to the battery mounting part 160. A larger kinetic energy is required to vibrate a component having a larger mass.

Therefore, transmission of vibration from the hammer bit 119 and the body 101 to the handle part 109 side during operation is suppressed. Further, due to increase of the mass of the handle part 109 side, the center of gravity of the hammer drill 100 with the battery pack 170 mounted thereto is set at a position closer to the handgrip 180. Therefore, a load on the user holding the handgrip 180 during operation is reduced.

Particularly, in the first and third embodiments, in the vertical direction of the hammer drill 100 in which the handgrip 180 extends, the body 101 is arranged on the upper side of the hammer drill 100, while the battery pack 170 is arranged on the lower side of the hammer drill 100. With this structure, the hammer drill 100 is balanced by the body 101 and the battery pack 170, so that the operability of the hammer drill 100 is enhanced.

Further, according to the first to third embodiments, a plurality of the battery packs 170 are mounted to the battery mounting part 160 to drive the hammer drill 100. Compared with a structure in which one battery pack having a relatively large capacity is mounted, the battery packs 170 each having a relatively small capacity are mounted, so that ease of operation of replacing (attaching/detaching) the battery pack 170 is improved. Further, in a case of the hammer drill 100 in which the battery packs 170 are electrically connected in parallel, the driving time of the hammer drill 100 is increased. In a case of the hammer drill 100 in which the battery packs 170 are electrically connected in series, the output of the hammer drill 100 is increased. Further, in a case of the hammer drill 100 in which the connection mode of the battery packs 170 can be switched between series connection and parallel connection, the connection mode can be selected by the user according to each operation which is different in load on the hammer drill 100. Thus, the hammer drill 100 is rationally driven.

According to the first to third embodiments, an impact force is generated in the hammer drill 100 in the axial direction of the hammer bit 119. As a result, vibration is caused in the hammer drill 100 mainly in the axial direction of the hammer bit 119. On the other hand, the battery pack 170 is mounted to the battery mounting part 160 by moving in the direction crossing the axial direction of the hammer bit 119. Therefore, the direction of movement of the battery pack 170 differs from the direction of vibration. Thus, the battery pack 170 is prevented from coming off the battery mounting part 160 during operation (hammering operation). Further, since the direction of movement of the battery pack 170 differs from the direction of vibration, vibration between the mounting guide 173 of the battery pack 170 and the guide rail 161 of the battery mounting part 160 is relatively small in the direction of movement of the battery pack 170. Therefore, wear which may be caused by sliding of the mounting guide 173 and the guide rail 161 in the direction of movement of the battery pack 170 is reduced. Likewise, vibration between the terminal 179 of the battery pack 170 and the terminal (not shown) of the battery mounting part 160 is also relatively small in the direction of movement of the battery pack 170. Therefore, chattering between the terminals is suppressed.

According to the first to third embodiments, the battery pack 170 is easily mounted to the battery mounting part 160 by sliding the mounting guide 173 of the battery pack 170 along the guide rail 161 of the battery mounting part 160.

In the above-described embodiments, it is configured such that the battery pack 170 is mounted to the battery mounting part 160 by sliding in the transverse direction of the hammer drill 100 which crosses both the axial direction of the hammer bit 119 and the extending direction of the handgrip 180, but it may be configured otherwise. For example, it may be configured such that the battery pack 170 is mounted to the battery mounting part 160 by sliding in the front-back direction or vertical direction of the hammer drill 100.

Further, in the above-described embodiments, the battery mounting part 160 is provided such that the two battery packs 170*a*, 170*b* are held by the handle part 109, but it may be provided otherwise. For example, one mounting part 160*a* of the battery mounting part 160 may be provided on the body 101 and the other mounting part 160*b* may be provided on the handle part 109. Specifically, it is only necessary to be configured such that at least one of the battery packs mounted to the hammer drill 100 is held by the handle part 109.

Further, in the above-described embodiments, it is configured such that the two battery packs 170 are mounted to the hammer drill 100, but it may be configured otherwise. For example, it may be configured such that one or three or more battery packs 170 are mounted to the hammer drill 100.

Further, in the above-described embodiments, the motion converting mechanism 120 is described having the swinging member 125, but it is not limited to this. A crank mechanism may be provided as the motion converting mechanism 120.

Further, in the above-described embodiments, the hammer drill 100 in which the hammer bit 119 performs hammering motion and rotating motion is described as a representative example of an impact tool, but the impact tool is not limited to this. For example, the present invention may be applied to an electric hammer, as the impact tool, in which the hammer bit 119 performs only hammering motion. The present invention may also be applied to an electric driver, an electric wrench, an electric grinder, an electric reciprocating saw and an electric jigsaw.

In view of the nature of the above-described invention, the impact tool according to this invention can have the following features. Each of the features may be used separately or in combination with the other, or in combination with the claimed invention.

(Aspect 1)

The impact tool has a driving mechanism which is driven by the electric motor and drives the tool accessory.

(Aspect 2)

The handle forming member moves with respect to the tool body in the prescribed longitudinal direction.

(Aspect 3)

The battery mounting part has a sliding part on which the battery slides, and the sliding part extends in a direction crossing the prescribed longitudinal direction.

(Aspect 4)

Two elastic members are arranged on opposite sides of an axis of the tool accessory in the handle extending direction.

(Aspect 5)

The two elastic members are arranged substantially at the same position in the longitudinal direction.

(Correspondences Between the Features of the Embodiments and the Features of the Invention)

Correspondences between the features of the embodiments and the features of the invention are as follows. The above-described embodiments are representative examples for embodying the present invention, and the present invention is not limited to the constructions that have been described as the representative embodiments.

The body 101 is an example embodiment that corresponds to the "tool body" according to the present invention.

The motor housing 103 is an example embodiment that corresponds to the "tool body" according to the present invention.

The gear housing 105 is an example embodiment that corresponds to the "tool body" according to the present invention.

The hammer bit 119 is an example embodiment that corresponds to the "tool accessory" according to the present invention.

The electric motor 110 is an example embodiment that corresponds to the "electric motor" according to the present invention.

The battery mounting part 160 is an example embodiment that corresponds to the "battery mounting part" according to the present invention.

The mounting parts 160*a*, 160*b* are an example embodiment that corresponds to the "battery mounting part" according to the present invention.

The battery pack 170 (170*a*, 170*b*) is an example embodiment that corresponds to the "battery" according to the present invention.

The handle part 109 is an example embodiment that corresponds to the "handle forming member" according to the present invention.

The support part 109*a* is an example embodiment that corresponds to the "connection part" according to the present invention.

The handgrip 180 is an example embodiment that corresponds to the "handle" according to the present invention.

The coil spring 107 is an example embodiment that corresponds to the "elastic member" according to the present invention.

The coil spring 107 is an example embodiment that corresponds to the "elastic element" according to the present invention.

DESCRIPTION OF THE NUMERALS

100 hammer drill
101 body
103 motor housing
103*a* slot
105 gear housing
106 guide shaft
106*a* screw
107 coil spring
109 handle part
109*a* support part
110 electric motor
119 hammer bit
120 motion converting mechanism
121 bevel gear
123 first intermediate shaft
125 swinging member
127 cylinder holding piston
140 striking mechanism
141 piston cylinder
142 air chamber
143 striker
145 impact bolt
150 power transmitting mechanism
151 second intermediate shaft
153 first intermediate gear
155 second intermediate gear
159 tool holder
160 battery mounting part
160*a* mounting part
160*b* mounting part
161 guide rail
170*a* battery pack
170*b* battery pack
171 battery case
173 mounting guide
175 hook
177 push button
179 terminal
180 handgrip
181 trigger
182 trigger switch
185 first slide guide
185*a* slot
186 second slide guide
186*a* slot
187 third slide guide
187*a* guide shaft

The invention claimed is:

1. An impact tool configured to drive a detachably mounted tool accessory in a longitudinal direction, comprising:

an electric motor for driving the tool accessory, a tool body that (1) houses the electric motor and (2) is an outer shell of the impact tool, a handle forming member having a handle (1) to be held by a user and (2) with a handle extending direction;

an elastic member that is disposed between the tool body and the handle forming member, and a plurality of battery mounting parts configured such that (1) one of a plurality of batteries is attached to each of the plurality of battery mounting parts and (2) the plurality of batteries is attached to the plurality of battery mounting parts by sliding the plurality of batteries in a direction transverse to the handle extending direction, such that the plurality of the battery mounting parts are aligned in the same direction, wherein the electric motor is driven by current that is supplied from the batteries mounted to the battery mounting parts, the handle forming member, the tool body and the elastic member are configured and positioned relative to each other such that the handle forming member moves with respect to the outer shell of the tool body under an elastic force of the elastic member along the longitudinal direction, and the plurality of battery mounting parts are connected to the handle forming member and configured to move together with the handle forming member with respect to the tool body.

2. The impact tool as defined in claim 1, wherein:

the handle is provided to extend in a handle extending direction crossing the longitudinal direction, and the battery is mounted to the battery mounting part by sliding with respect to the battery mounting part in a crossing direction crossing the longitudinal direction and the handle extending direction.

3. The impact tool as defined in claim 1, wherein the handle is provided to extend in a handle extending direction crossing the longitudinal direction, and at least part of the handle is arranged on an axis of the tool accessory.

4. The impact tool as defined in claim 3, wherein the battery mounting part is connected to one end region of the handle in the handle extending direction.

5. The impact tool as defined in claim 1, wherein the electric motor is arranged such that a rotation axis of the electric motor extends in a direction crossing the longitudinal direction.

6. The impact tool as defined in claim 1, wherein the electric motor is arranged such that a rotation axis of the electric motor extends in parallel to the longitudinal direction.

7. The impact tool as defined in claim 6, wherein the handle forming member has a connection part which connects a region of the handle forming member located toward the tool accessory from the handle in the longitudinal direction and one end region of the handle.

8. The impact tool as defined in claim 7, wherein the battery mounting part is connected to the connection part.

9. The impact tool as defined in claim 1, wherein:

the elastic member comprises a plurality of elastic elements provided at plural places, and the handle forming member is configured to move with respect to the tool body under elastic forces of the elastic elements.

10. The impact tool as defined in claim 1, wherein the tool body is a unitary tool body.

* * * * *